US007104729B2

(12) United States Patent
Cressi

(10) Patent No.: US 7,104,729 B2
(45) Date of Patent: Sep. 12, 2006

(54) BUOYANCY COMPENSATOR JACKET FOR SCUBA DIVERS WITH IMPROVED WEIGHT POCKETS

(75) Inventor: Leopoldo Antonio Cressi, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 90 days.

(21) Appl. No.: 10/431,141

(22) Filed: May 6, 2003

(65) Prior Publication Data

US 2003/0211790 A1 Nov. 13, 2003

(30) Foreign Application Priority Data

May 7, 2002 (IT) ..... FI20020049 U

(51) Int. Cl.
*B63C 11/02* (2006.01)

(52) U.S. Cl. ..... 405/186; 441/106

(58) Field of Classification Search ..... 405/185, 405/186; 441/88, 106; 114/315; 2/312, 311, 2/243.1, 102

See application file for complete search history.

(56) References Cited

U.S. PATENT DOCUMENTS

| | | | | |
|---|---|---|---|---|
| 119,210 | A | 9/1871 | Wilson | |
| 836,524 | A | 11/1906 | Morrell | |
| 1,285,741 | A | 11/1918 | Konopski | |
| 2,593,988 | A | 4/1952 | Cousteau | 128/144 |
| 3,064,287 | A | 11/1962 | Maholm | 9/319 |
| 3,105,359 | A | 10/1963 | Ellis | 61/70 |
| 3,487,647 | A | 1/1970 | Brecht, Jr. | 61/69 |
| 3,536,071 | A | 10/1970 | Ferrando | 128/142.5 |
| 3,720,208 | A | 3/1973 | Aldrich et al. | 128/142.5 |
| 3,727,250 | A | 4/1973 | Koehn et al. | 9/313 |
| 3,747,139 | A | 7/1973 | Braly | 9/313 |
| 3,866,253 | A | 2/1975 | Sinks et al. | 9/313 |

(Continued)

FOREIGN PATENT DOCUMENTS

| | | |
|---|---|---|
| DE | 2949402 | 6/1980 |
| EP | 0826594 A2 | 3/1998 |
| GB | 1587124 | 4/1981 |
| JP | 1218996 A | 9/1989 |
| WO | 0210012 A1 | 2/2002 |

OTHER PUBLICATIONS

AMF Voit, Inc. Advertisement, *Skin Diver Magazine*, dated May, 1974. See Advertisement, p. 2.

AMF *Swimaster* Professional Diving Equipment Catalog, Catalog No. 274D, dated 1974.

Sherwood Freedom Brand Buoyancy Compensator Sales Brochure undated.

*Primary Examiner*—Heather Shackelford
*Assistant Examiner*—Lisa Saldano
(74) *Attorney, Agent, or Firm*—Pollack, P.C.; Grant E. Pollack

(57) ABSTRACT

A buoyancy compensator jacket for a scuba diver is disclosed. The jacket comprises a back portion having two opposite sides. Side portions extending from the opposite sides are provided for laterally enveloping the diver's trunk and for connecting to one another generally on the diver's chest. Each of the side portions include a main pocket and a weight pocket, the weight pocket having a top opening, being arranged externally relative to the main pocket, and accommodating a bag containing weight elements. A closure element is also provided for closing the top opening of the weight pocket. In addition, the main pocket forms a compartment for concealing a closure element of its top opening. On the outside of the weight pocket, engagement elements are arranged either for engaging complementary engagement elements on the closure element, or for engaging complementary engagement elements associated with the weight-containing bag for holding the bag in a selected position within the weight pocket.

9 Claims, 2 Drawing Sheets

U.S. PATENT DOCUMENTS

| | | | | |
|---|---|---|---|---|
| 3,898,705 | A | | 8/1975 | Schuler ..... 9/313 |
| 3,964,266 | A | | 6/1976 | Bartlett ..... 61/70 |
| 4,000,534 | A | | 1/1977 | Cerniway et al. ..... 9/342 |
| 4,016,616 | A | | 4/1977 | Walters ..... 9/339 |
| 4,045,835 | A | | 9/1977 | Flam et al. ..... 9/313 |
| 4,054,132 | A | | 10/1977 | Deeds ..... 128/142 R |
| 4,068,657 | A | | 1/1978 | Kobzan ..... 128/142 R |
| 4,114,389 | A | | 9/1978 | Bohmrich et al. ..... 405/186 |
| 4,137,585 | A | | 2/1979 | Wright, III ..... 9/314 |
| 4,227,521 | A | | 10/1980 | Hart et al. ..... 128/202.14 |
| 4,242,769 | A | | 1/1981 | Rayfield et al. ..... 9/330 |
| 4,379,656 | A | | 4/1983 | Darling ..... 405/186 |
| 4,437,790 | A | | 3/1984 | Trop ..... 405/186 |
| 4,523,914 | A | | 6/1985 | Faulconer et al. ..... 441/108 |
| 4,529,333 | A | | 7/1985 | Robinette ..... 405/186 |
| 4,608,940 | A | | 9/1986 | Bulin ..... 114/315 |
| 4,623,316 | A | | 11/1986 | Ratliff ..... 441/106 |
| 4,681,552 | A | | 7/1987 | Courtney ..... 405/186 |
| 4,720,281 | A | | 1/1988 | Matsuoka ..... 441/92 |
| 4,752,263 | A | | 6/1988 | Pritchard et al. ..... 441/88 |
| 4,779,554 | A | | 10/1988 | Courtney ..... 114/315 |
| 4,810,134 | A | | 3/1989 | Eaulconer et al. ..... 405/186 |
| 4,907,729 | A | | 3/1990 | Hess, III ..... 224/253 |
| 4,913,589 | A | | 4/1990 | Faulconer et al. ..... 405/186 |
| 4,986,700 | A | | 1/1991 | Takeda ..... 405/186 |
| 5,085,163 | A | | 2/1992 | Van Tassel et al. ..... 114/315 |
| 5,159,961 | A | | 11/1992 | Snetting et al. ..... 141/10 |
| 5,205,672 | A | | 4/1993 | Stinton ..... 405/186 |
| 5,221,161 | A | | 6/1993 | Toy ..... 405/186 |
| 5,256,094 | A | | 10/1993 | Canna ..... 441/96 |
| 5,311,833 | A | | 5/1994 | Van Tassel et al. ..... 114/315 |
| 5,520,485 | A | | 5/1996 | Hermansen ..... 405/186 |
| 5,607,258 | A | | 3/1997 | Eungard ..... 405/186 |
| 5,620,282 | A | | 4/1997 | Stinton ..... 405/186 |
| 5,707,177 | A | | 1/1998 | Lehrer et al. ..... 405/186 |
| 5,788,415 | A | | 8/1998 | Chen ..... 405/186 |
| 5,803,667 | A | | 9/1998 | Seligman ..... 405/186 |
| 5,944,450 | A | * | 8/1999 | Anderson ..... 405/186 |
| 5,980,158 | A | | 11/1999 | Griffiths et al. ..... 405/186 |
| 6,039,043 | A | | 3/2000 | Graber et al. ..... 128/202.14 |
| 6,478,509 | B1 | * | 11/2002 | Powley ..... 405/186 |
| 6,527,480 | B1 | * | 3/2003 | Angelini et al. ..... 441/88 |
| 6,546,561 | B1 | | 4/2003 | Duhamell ..... 2/102 |
| 6,558,082 | B1 | | 5/2003 | Caurtney et al. ..... 405/186 |
| 6,722,819 | B1 | | 4/2004 | Godoy ..... 405/186 |
| 6,758,635 | B1 | * | 7/2004 | Feng ..... 441/106 |
| 2001/0018008 | A1 | | 8/2001 | Powley ..... 405/186 |
| 2002/0013107 | A1 | | 1/2002 | Angelini et al. ..... 441/88 |
| 2002/0057946 | A1 | | 5/2002 | Beltrani ..... 405/186 |

* cited by examiner

BUOYANCY COMPENSATOR JACKET FOR SCUBA DIVERS WITH IMPROVED WEIGHT POCKETS

FIELD OF THE INVENTION

The present invention relates generally to equipment for use in extreme environments and, more particularly, to a jacket for underwater activities.

BACKGROUND OF THE INVENTION

Scuba divers and others who engage in underwater locomotion experience forces of buoyancy that can effect the ease with which they move about. To control or counter these forces, specialized jackets with one or more air chambers are commonly used for underwater buoyancy compensation. Typically, these jackets are inflated either by mouth or using an inflation device operated by compressed gas, and deflated in order to provide buoyancy trim and/or compensation to the diver as he or she moves about.

An objective of these jackets is to maintain the buoyancy of the diver in a substantially neutral state as his/her depth varies, thereby assuring that he/she will be able to move with utmost ease in any direction. Generally speaking, as the diver dives deeper, the increase in water pressure not only tends to compress some of the diver's body cavities, but also his or her wet suit and the diving equipment associated therewith. In this manner, the inherent lifting characteristics will decrease, making the ascension movements harder. Such decrease may be compensated for by progressive inflation of the jacket. Conversely, as the diver ascends to the surface, his/her inherent buoyancy will increase and the jacket must, therefore, be gradually deflated in order to maintain overall buoyancy at a substantially neutral level.

Weight belts are traditionally used to assist the diver in neutralizing his or her buoyancy. These belts are usually provided with quick-release buckles that enable the diver, in the event of an emergency, to readily free himself or herself of the additional weight, thereby assisting his or her return to the surface. Recently, more and more, at least a part of the weight has been incorporated in buoyancy jackets. This is not only because weight belts have been found uncomfortable to wear, but also because they are frequently an obstacle to the diver's movements. Due to safety considerations, the diver must be able to free himself or herself of the weight quickly and easily.

A buoyancy compensator jacket suitable for incorporating weights is described in Italian Utility Model No. 244660 to the present applicant. In particular, weight elements are placed in pockets formed in side portions of the jacket. Each pocket is arranged in proximity to a back portion of the jacket and has a substantially tubular shape, with a top opening for introdu-cing the weight elements into the pocket and a bottom opening for allowing them to drop therefrom. Respective closure elements, in turn, are associated with the ope-nings. Closure of the bottom openings is accomplished using quick-release buckles.

Although this arrangement has been found effective, not only are the benefits of additional functions desired, but also enhancement of aesthetic appearance, without sacrificing efficacy or production costs.

OBJECTS AND SUMMARY OF THE INVENTION

In accordance with one aspect of the present invention, a buoyancy compensator jacket is provided, which comprises a back portion and two side portions extending from respective opposite sides of the back portion, the side portions being suitable for wrapping the diver's trunk and for connection to one another on his or her chest. A main pocket and a weight pocket, each with a top opening, are formed in each of the side portions. The weight pocket is arranged on an outside surface of the main pocket and is configured for housing a weight-containing bag. The weight pocket is also provided with a closure element for its top opening thereof. The jacket also has a compartment formed in the main pocket for concealing the closure element of its top opening, and an engagement element on an outside surface of the weight pocket, complementary engagement elements being provided on the closure elements and on the weight-containing bag, whereby the engagement elements of the weight pocket are engageable with either complementary engagement elements of the closure elements, or with complementary engagement elements associated with the weight-containing bag so as to keep the weight-containing bag in position within the weight pocket.

BRIEF DESCRIPTION OF THE DRAWINGS

A specific, illustrative buoyancy compensator jacket, in accordance with the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 3:
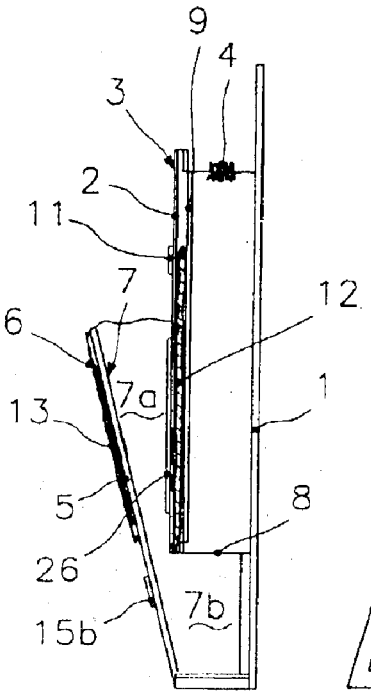
FIG. 3 is sectional view of the jacket side portion taken along line III—III of FIG. 1.

Referring now to the drawings and more particularly to FIGS. 1–6, there is shown generally a specific, illustrative, buoyancy compensator jacket, according to various aspects of the present invention. According to one embodiment, the jacket is provided with two side portions 1—only one of which is shown in the figures—that extend from opposite sides of a back portion of the jacket—not shown. The side portions 1 having, for example, a conventional four-sided shape overall, are suitable for wrapping laterally around the diver's trunk and for connection to each other in a known manner substantially on the diver's chest using a belt not shown in the figures.

Figure 1:
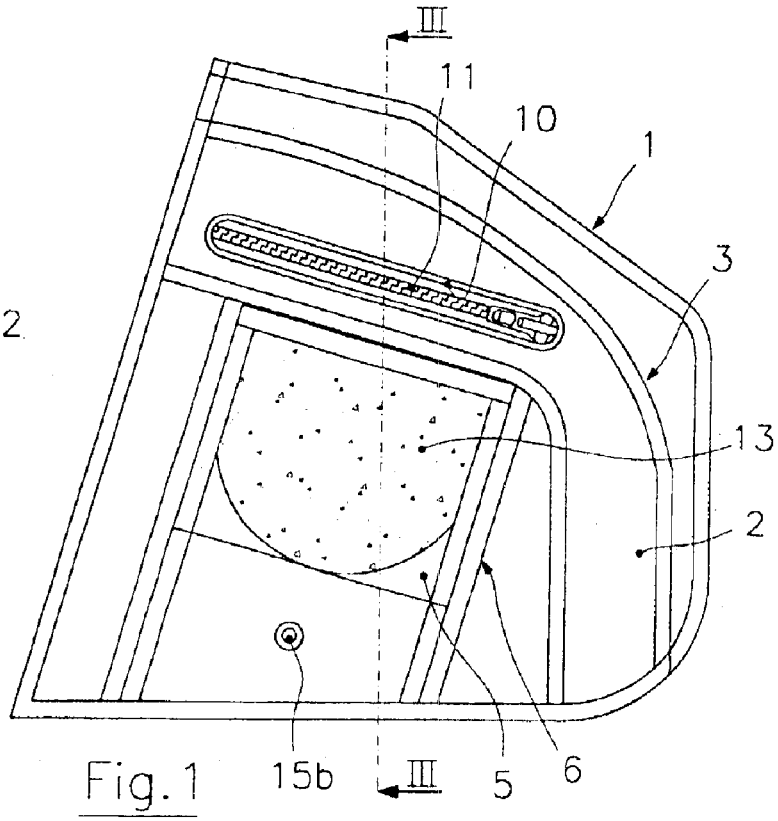
FIG. 1 is a plan view of a side portion of a jacket, according to one aspect of the present invention, showing weight pocket in open configuration.
Figure 2:
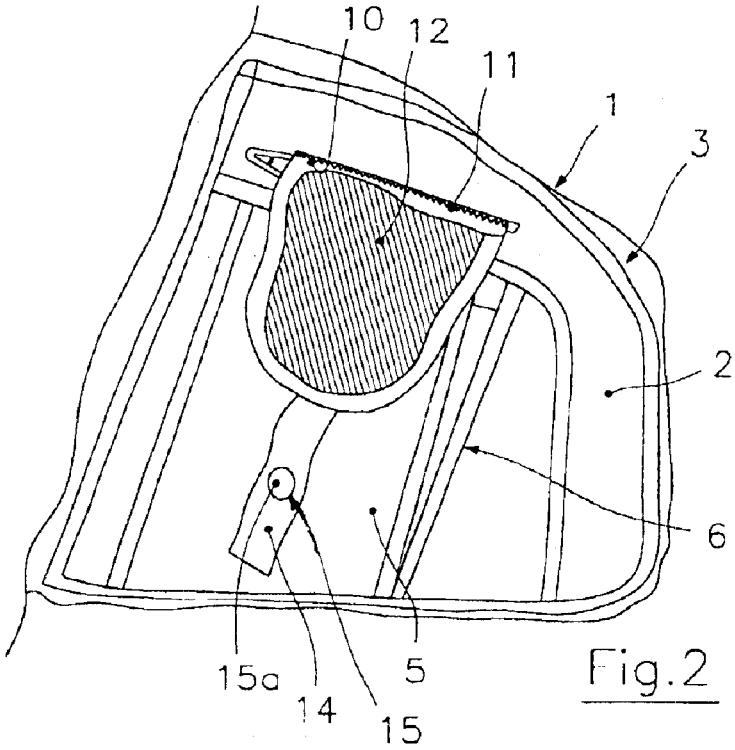
FIG. 2 is a plan view of the jacket side portion shown in FIG. 1 with the pocket in a closed configuration.
Figure 5:
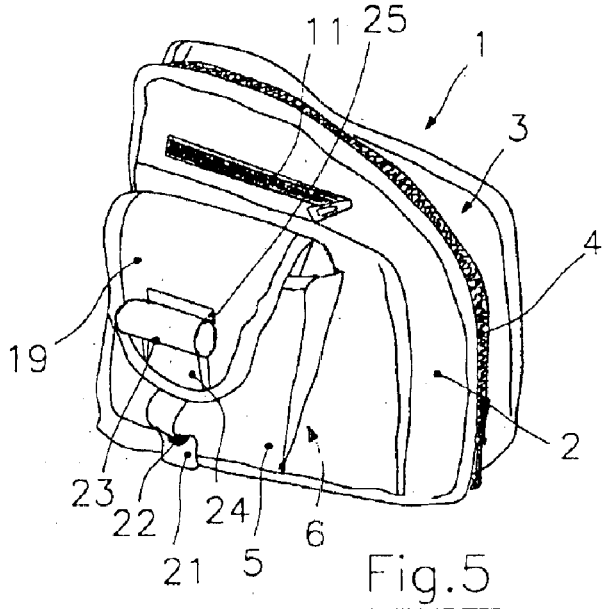
FIG. 5 is a perspective view of the jacket side portion of FIGS. 1–4 showing a weight bag inserted in a pocket.
Figure 6:
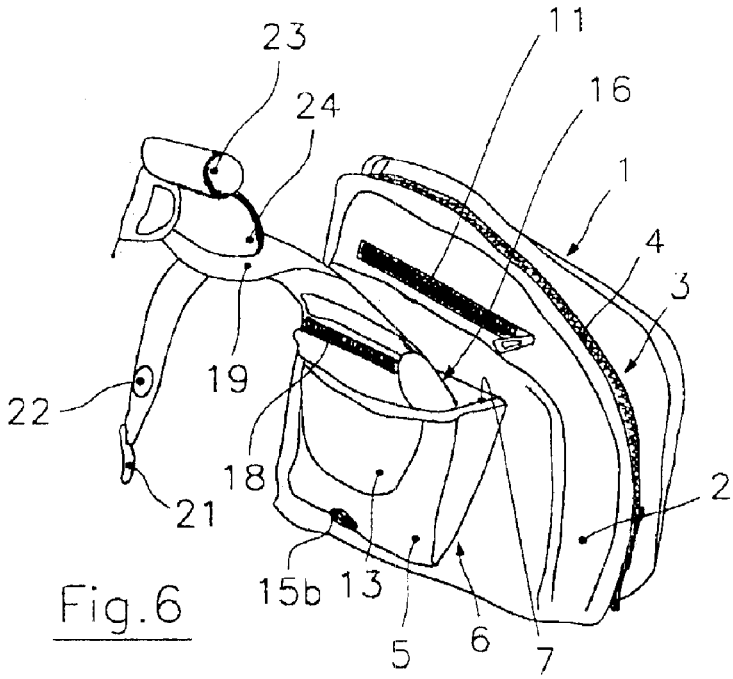
FIG. 6 is a perspective view of the jacket side portion shown in FIG. 5 illustrating the weight bag being extracted from the pocket.

On the outer surface of each side portion 1, a patch 2 attached in gusset-fashion defines a main pocket 3, the inside of which is accessible from the top side through an opening closed desirably by a zip fastener 4 that can be seen in FIGS. 5 and 6 and, in section, also in FIG. 3. Another patch 5 is attached in gusset-fashion on the outside of patch 2, generating a weight pocket 6 that, when seen from in front as in FIGS. 1 and 2, is of smaller width and height than main pocket 3, and extends in a slightly oblique direction. As show in the section view of FIG. 3, weight pocket 6 delimits a housing 7 of composite shape, with an outer portion 7*a* that extends outside patch 2 of main pocket 3 and an inner portion 7*b* that, through an opening formed in patch 2, projects into the interior of main pocket 3, though being physically separated therefrom by a partition 8 that extends between patch 2 and side portion 1.

As also shown in FIG. 3, gusset-shaped patch 2 of main pocket 3 has a twin layer structure that defines a compartment 9 accessible from the outside through a slit 10 running above the upper edge of weight pocket 6. Slit 10 is closed preferably by a zip fastener 11. Compartment 9 accommodates a tongue of fabric, joined to the interior of patch 2 contiguously to slit 10 and extractable from the compartment through the same slit, so as to be able to act, as can be seen in FIG. 2, as a cover flap 12 for closing weight pocket 6. To this end, cover flap 12 is provided on its inside face (reference is made to the extracted configuration of FIG. 2) with a suitable fastener such as a Velcro® closure element—not shown in the figure—that engages a complementary element 13 that can be seen in FIGS. 1 and 6, and is sewn to the outside of patch 5 of weight pocket 6.

Furthermore, a strip 14 extends from cover flap 12 in a longitudinal direction, the strip making it easier for the diver to grab the flap. In addition, a first element 15*a* of snap fastener 15 is affixed to strip 14. Desirably, a complementary element 15*b* of fastener 15 is attached to a patch 5 of weight pocket 6, below Velcro® element 13. In this manner, the weight pocket 6 adjacent to cover flap 12 may be closed in a more secure fashion by snap fastener 15.

Figure 4:
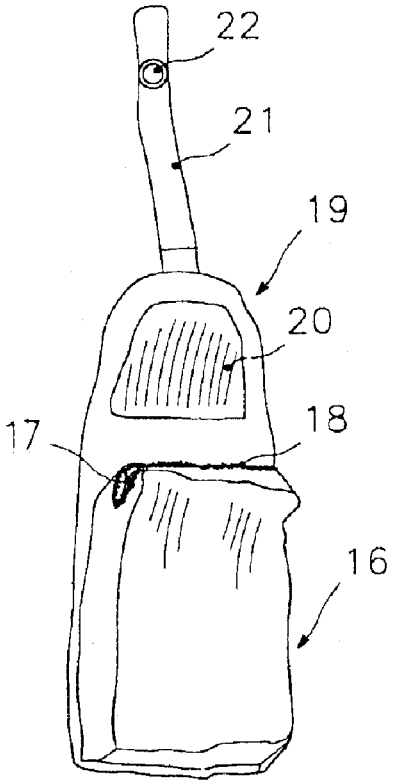
FIG. 4 is a perspective view of a weight bag to be arranged in one of the pockets of the jacket in accordance with FIGS. 1–3.

Referring now to FIG. 4, a weight bag 16 for insertion into weight pocket 6 is preferably made of a semi-rigid material and has the overall shape of a parallelepiped with an opening 17 on one of its faces. Opening 17 has a zip fastener for closure and permits one or more weight elements to be inserted. In this manner, it is possible to obtain the overall weighting desired by a diver, the determination of which requires that the body weight of the diver who will wear the jacket be taken into account.

Weight-containing bag 16 is also provided with a closure flap 19 that projects from a face situated along an edge of weight pocket 6 when the weight-containing bag is inserted. Cover flap 19 has a configuration similar to that of cover flap 12, the cover flap being provided with a Velcro® element on its inside face for engaging element 13 on patch 5. The cover flay also has a strip 21 with an element of a snap fastener 22 for engaging element 15*b*.

Furthermore, as shown in FIGS. 5 and 6, from the outer face of cover flap 19 there projects a small gripping knob 23. More particularly, knob 23 is connected to a tongue 24 sewn to cover flap 19 along its edge. Tongue 24, therefore, points with it free end, to which knob 23 is attached, toward the base of cover flap 19 by suitable fasteners such as a further Velcro® connection of which an element 25 is attached to flap 19 and can be seen in FIG. 5.

Because of cover flap 19, when weight bag 16 is inserted in housing 7 of pocket 6, it can be locked firmly in position—as shown in FIG. 5—due to the simultaneous action of Velcro® elements 20, 13 and the snap fastener elements 22, 15*b*. A supplemental Velcro® connection between the rear of weight bag 16 and patch 2 can further enhance the firmness of positioning of the bag. The element of this connection attached to patch 2 can be seen in the section of FIG. 3, where it is indicated at the reference number 26.

In the configuration that has just been described, cover flap 12 associated with patch 2 of main pocket 3 is concealed in compartment 9, which is closed by zip fastener 11. Due not only to the shape of housing 7 and, more particularly, its inner portion 7*b* which deprives main pocket 3 of useful space, but also the deformability of this pocket, bag 16 will not protrude excessively from the front of side portion 1, thus reducing to a minimum the discomfort that it could cause for the diver's movements. Moreover, the small gripping knob 23 will remain in contact with cover flap 19 of weight bag 16 as a result of the Velcro® connection acting on tongue 24.

Another advantage of the present invention is that, in the event of an emergency, the diver is able to readily and easily ditch the weight-containing bag—and, therefore, also the weight it contains. To accomplish this, all the diver must do is firmly pull flap 19 upwardly and outwardly using gripping knob 23. As set forth in FIG. 6, this pulling action will cause tongue 24 to detach from flap 19 and be raised toward the outside. In addition to making it easier for the diver to comfortably grip knob 23, this action brings the point of exertion of the force into a favorable position for disengaging snap fastener element 22. As the diver continues to pull, weight-containing bag 16 is, thereby, quickly extracted from housing 7 of pocket 6.

When housing 7 is not used i.e., does not contain weight-containing bag 16, it can easily be used for holding objects. If cover flap 12 is removed and placed on an outside surface of patch 5 of pocket 6, with which it becomes engaged by Velcro® elements and snap fastener 15, the housing will be closed in a highly secure manner.

As this demonstrates, the weight pocket of the present invention offer extraordinary result, not only in the stability with which the jacket carries weights, but also the diver's ability to get rid of such weights, quickly and safely, in the chaos of an emergency. Both of these advantages are achieved by flap 19 of weight-containing bag 16, which acts both as a securement device and a pull-out strap.

Generally speaking, use of weight pocket 6 as an object-holder is both desirable and encouraged, given that cover flap 12, which avails itself of the elements (Velcro® and snap fastener) already provided for connection with weight bag 16, provides not only safety and assurance that objects stored will not be lost, but also a pleasant aesthetic appearance. In addition, it is noted that the weight pocket configuration, in accordance with the present invention, is very simple, so that the pocket may be produced at a relatively low cost. Last, a further benefit of the present invention is the composite form of housing 7, which incorporates weights in the buoyancy compensator jacket without creating an excessive bulge on the outside of the jacket.

The other features of buoyancy compensator jackets are known by those skilled in the art, and further description is considered unnecessary for purposes of illustrating the present invention. In addition, various modifications and alterations to the invention may be appreciated based on a review of this disclosure. These changes and additions are intended to be within the scope and spirit of the invention as defined by the following claims.

What is claimed is:

1. A buoyancy compensator jacket comprising a back portion and two side portions extending from respective opposite sides of the back portion, the side portions being suitable for wrapping a diver's trunk and connection to one another on the diver's chest, each of the side portions having a main pocket, a weight pocket arranged on an outside surface of the main pocket with a top opening for housing a weight-containing bag, and a closure element for the top opening, the jacket further comprising a compartment formed in the main pocket for concealing the closure element, and an engagement element on an outside surface of the weight pocket, each of the closure element and the weight-containing bag having a complementary engagement element, whereby the engagement element of the weight pocket is either engageable with a complementary engagement element of the closure element, or with a complementary engagement element of the closure element associated with the weight-containing bag so as to keep the weight-containing bag in position within the weight pocket.

2. The jacket set forth in claim 1, wherein the main pocket is defined between the side portion and a twin-layer patch that forms the compartment, the latter being accessible from the outside through a slit running above the top opening of the weight pocket, the closure element consisting of a cover flap connected to the interior of the compartment in proximity to the slit, the weight-containing bag being provided with an equally shaped cover flap capable of being arranged outside the weight pocket when the bag is inserted in it.

3. The jacket set forth in claim 2, wherein the slit of the compartment is closed by a zip fastener.

4. The jacket set forth in claim 2, wherein the engagement element on the outside of the weight pocket comprises a hook and loop fastener element, complementary hook and loop fastener elements being arranged, respectively, on an internal face of the cover flap for closing the weight pocket and on an internal face of the cover flap of the weight-containing bag.

5. The jacket set forth in claim 4, wherein both the cover flap for closing the weight pocket and the cover flap of the weight-containing bag comprise respective strips projecting from a respective free edge thereof, in order to make it easier for the driver to grip the cover flaps, the engagement element on the outside of the weight pocket also comprising a snap fastener element arranged below the hook and loop fastener element, complementary snap fastener elements being provided, respectively on the strip of the cover flap for closing the weight pocket and on the strip of the cover flap of the weight-containing bag.

6. The jacket set forth in claim 2, further comprising a supplementary hook and loop fastener connection within the weight pocket, acting between the weight-containing bag and the patch.

7. The jacket set forth in claim 2, wherein a grip element projects from an outside face of the cover flap of the weight-containing bag.

8. The jacket set forth in claim 7, wherein the grip element comprises a tongue connected to the edge of the cover flap of the weight-containing bag and pointing with its free end, to which a small gripping knob is fixed, towards the base of the cover flap, the free end of the tongue being reversibly connected to the cover flap of the weight-containing bag by a further hook and loop fastener connection.

9. The jacket set forth in claim 2, wherein the weight pocket defines a housing comprising an outer portion that extends on the outside of the patch of the main pocket, and an inner portion that, through an opening provided on the patch, projects into the interior of the main pocket, though being physically separated therefrom by a partition extending between the patch and the side portion.

* * * * *